US011686305B2

(12) United States Patent
Buckley

(10) Patent No.: US 11,686,305 B2
(45) Date of Patent: Jun. 27, 2023

(54) POWER END FOR HYDRAULIC FRACTURING PUMP

(71) Applicant: ST9 Gas and Oil, LLC, The Woodlands, TX (US)

(72) Inventor: Christopher Paul Buckley, Montgomery, TX (US)

(73) Assignee: ST9 Gas and Oil, LLC, The Woodlands, TX (US)

( * ) Notice: Subject to any disclaimer, the term of this patent is extended or adjusted under 35 U.S.C. 154(b) by 0 days.

(21) Appl. No.: 17/236,881

(22) Filed: Apr. 21, 2021

(65) Prior Publication Data

US 2021/0239112 A1 Aug. 5, 2021

Related U.S. Application Data

(63) Continuation of application No. 16/680,305, filed on Nov. 11, 2019, now Pat. No. 11,009,024.

(51) Int. Cl.

| | |
|---|---|
| ***F04B 53/16*** | (2006.01) |
| ***F04B 1/2064*** | (2020.01) |
| ***F04B 1/22*** | (2006.01) |
| ***E21B 43/26*** | (2006.01) |
| ***F04B 53/18*** | (2006.01) |
| ***F04B 15/02*** | (2006.01) |

(52) U.S. Cl.

CPC ..... *F04B 53/16* (2013.01); *E21B 43/26* (2013.01); *F04B 1/2064* (2013.01); *F04B 1/22* (2013.01); *F04B 15/02* (2013.01); *F04B 53/18* (2013.01)

(58) Field of Classification Search

CPC ..... F04B 53/16; F04B 53/162

See application file for complete search history.

(56) References Cited

U.S. PATENT DOCUMENTS

| | | | | |
|---|---|---|---|---|
| 2,237,113 | A * | 4/1941 | Plumb | F01B 7/12 123/51 BB |
| 9,879,659 | B2 | 1/2018 | Kumar et al. | |
| 10,352,321 | B2 | 7/2019 | Byrne et al. | |
| 2017/0370524 | A1 | 12/2017 | Wagner | |

* cited by examiner

*Primary Examiner* — Kenneth Bomberg
*Assistant Examiner* — Michael Quandt
(74) *Attorney, Agent, or Firm* — Haynes and Boone, LLP

(57) ABSTRACT

A hydraulic fracturing pump includes a power end with a plurality of torsion tubes extending between sides of a crankcase housing in which a crankshaft is rotatably mounted. The crankshaft is coupled by piston arms to crossheads disposed to reciprocate along crosshead axes that are perpendicular to the crankshaft. Disposed within the crankcase housing are a plurality of ribs generally perpendicular to the crankshaft and extending from the base of the crankshaft housing to an upper surface of the crankshaft housing. The torsion tubes are generally adjacent the upper surface of the crankcase housing and pass perpendicularly through each of the plurality of ribs and are attached to the ribs to provide rigidity to the power end.

19 Claims, 7 Drawing Sheets

POWER END FOR HYDRAULIC FRACTURING PUMP

CROSS REFERENCE TO RELATED APPLICATION(S)

The present application is a Continuation of U.S. patent application Ser. No. 16/680,305, filed Nov. 11, 2019, the disclosure of which is hereby incorporated by reference in its entirety.

TECHNICAL FIELD

The present application relates generally to hydraulic fracturing in oil and gas wells, and in particular to a hydraulic fracturing pump power end strengthened with torsion tubes.

BACKGROUND

It is difficult to economically produce hydrocarbons from low-permeability reservoir rocks. Oil and gas production rates are often boosted by hydraulic fracturing, a technique that increases rock permeability by opening channels through which hydrocarbons can flow to recovery wells. Hydraulic fracturing has been used for decades to stimulate production from conventional oil and gas wells. The practice consists of pumping fluid into a wellbore at high-pressure (sometimes as high as 50,000 PSI). Inside the wellbore, large quantities of proppants are carried in suspension by the fracture fluid into the fractures. When the fluid enters the formation, it fractures, or creates fissures, in the formation. Water, as well as other fluids, and some solid proppants, are then pumped into the fissures to stimulate the release of oil and gas from the formation. When the pressure is released, the fractures partially close on the proppants, leaving channels for oil and gas to flow.

Fracturing rock in a formation requires that the fracture fluid be pumped into the wellbore at very high-pressure. This pumping is typically performed by high-pressure, hydraulic fracturing pumps, with a diesel engine used to power operation of the pump to deliver fracture fluids at sufficiently high flow rates and pressures to complete a hydraulic fracturing procedure or "frac job." These pumps are generally comprised of a power end and a fluid end. The fluid end of such a pump is utilized to pressurize a working fluid and may include a fluid suction manifold, a fluid discharge manifold, a fluid cylinder and a plunger. The power end of such a pump may include a crankcase in which a crankshaft is rotated in order to drive a plurality of piston arms. The piston arms in turn reciprocate crossheads. These crossheads are attached to the plunger(s) of the fluid end to drive the plunger(s) within the fluid cylinder. In some configurations, a power source, such as a diesel engine, is utilized to drive the crankshaft directly, while in other configurations, the power source may drive a pinion which in turn drives the crankshaft via a gearset. In any event, the hydraulic fracturing pumps are able to pump fracturing fluid into a wellbore at a high enough pressure to crack the formation. Typically, these hydraulic fracturing pumps operate for long periods of time and at high rates of speed to achieve the desired fluid pressure and formation fracturing. As a result, these pumps are subject to significant stresses. In particular, the power end of the hydraulic pumps experiences stress in the crankshaft housing in part from the many different moving pump components, such as the crankshaft, pinion, gearset and cross-heads, all of which may be operating along different axis of motion.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Generally, the power end of a hydraulic fracturing pump is provided. The power end includes a crankshaft housing through which a crankshaft extends along a crankshaft axis. Rotation of the crankshaft drives a plurality of piston arms which in turn cause reciprocation of a plurality of crossheads mounted in the crankshaft housing. Each crosshead has a crosshead axis along which the crosshead reciprocates. Each crosshead axis is generally perpendicular to the crankshaft axis. A plurality of spaced apart ribs are formed within the crankshaft housing and are also perpendicular to the crankshaft axis. At least one, and in some embodiments, a plurality of torsion tubes extend within the crankcase housing generally parallel with the crankcase axis so as to perpendicularly intersect the ribs. Each torsion tube is attached to at least two, and in some embodiments, a plurality of ribs. In some embodiments, the torsion tubes are welded to each rib the torsion tubes intersect. The power end may include a pinion shaft and gear extending through the crankcase housing so as to be generally parallel with the crankshaft axis. The pinion gear may be coupled the crankshaft through a gearset. In one or more embodiments, the plurality of torsion tubes are positioned within the crankcase housing so as to be angularly spaced apart from the pinion shaft about the crankshaft axis. The angular spacing may be at least 90 degrees. In one or more embodiments, at least one torsion tube is hollow, includes a plurality of apertures formed along the length of the torsion tube and is in fluid communication with an oil source so as to supply oil to interior of the crankcase housing.

Figure 1:
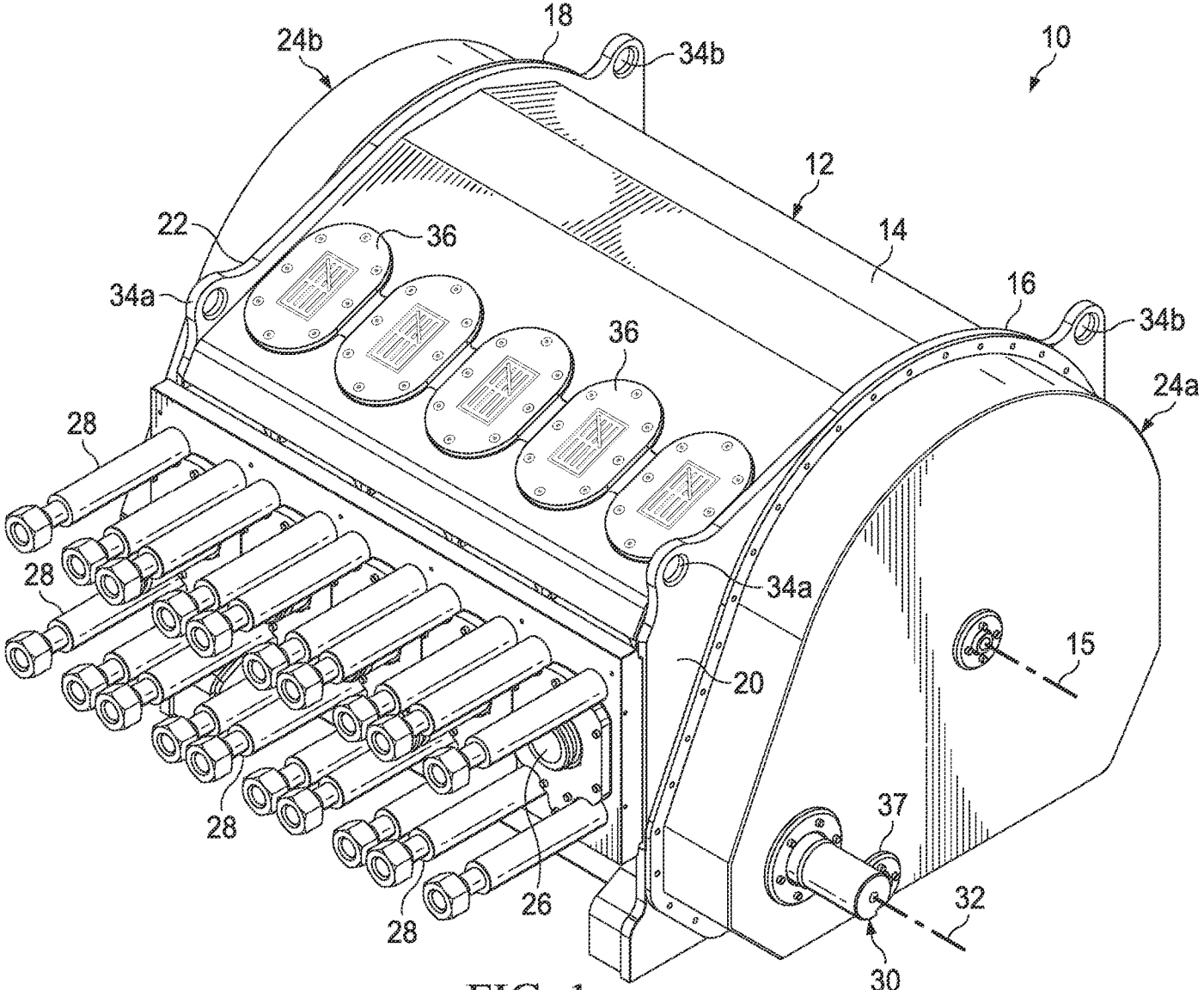
FIG. 1 is a perspective view of the power end of a hydraulic fracturing pump system according to embodiments of the present disclosure.

In FIG. 1, is a perspective view of a power end 10 of a hydraulic fracturing pump (not shown). Power end 10 generally includes a crankcase 12 formed of a crankcase housing 14 extending along a crankcase axis 15, the crankcase housing 14 having a first end 16 and a second end 18 with a first side 20 enclosing the crankcase housing 14 at the first end 16 and a second side 22 enclosing the crankcase housing 14 at the second end 18. In one or more embodiments, a gearbox assembly 24 may be attached to at least one of the ends 16, 18 of crankcase housing 14. In the illustrated embodiment, a first gearbox assembly 24*a* is attached to the first end 16 of crankcase 12 and a second gearbox assembly 24*b* is attached to the second end 18 of crankcase 12. A plurality of crosshead extension rods 26 are shown extending from crankcase housing 14. In one or more embodiments, a plurality of stay rods 28 may also extend from crankcase housing 14 generally adjacent to and parallel with crosshead extension rods 26. Persons of skill in the art will appreciate that a wet end (not shown) of a hydraulic fracturing pump may generally be attached to say rods 28 as is well known in the industry.

In one or more embodiments, power end 10 may include a pinion gear assembly 30 having a pinion axis 32 and generally extending at least partially between the first side 20 and the second side 22 of crankcase housing 14. It will be appreciated that pinion gear assembly 30 may be coupled to a power source (not shown) to drive power end 10. In other embodiments, pinion gear assembly 30 may be eliminated and the power source (not shown) may be coupled directly to a crankshaft, such as the crankshaft described below. In these embodiments, it will be appreciated that one or both gearbox assemblies 24*a*, 24*b* may also be eliminated.

In one or more embodiments, crankcase 12 may include one or more eye flanges 34. In the illustrated embodiment, each first side 20 includes a forward eye flange 34*a* and a rear eye flange 34*b*, and second side 22 likewise includes a forward eye flange 34*a* and a rear eye flange 34*b*. Crankcase 12 may further include one or more access covers 36. An oil port 37 is shown formed within crankcase 12.

Figure 2:
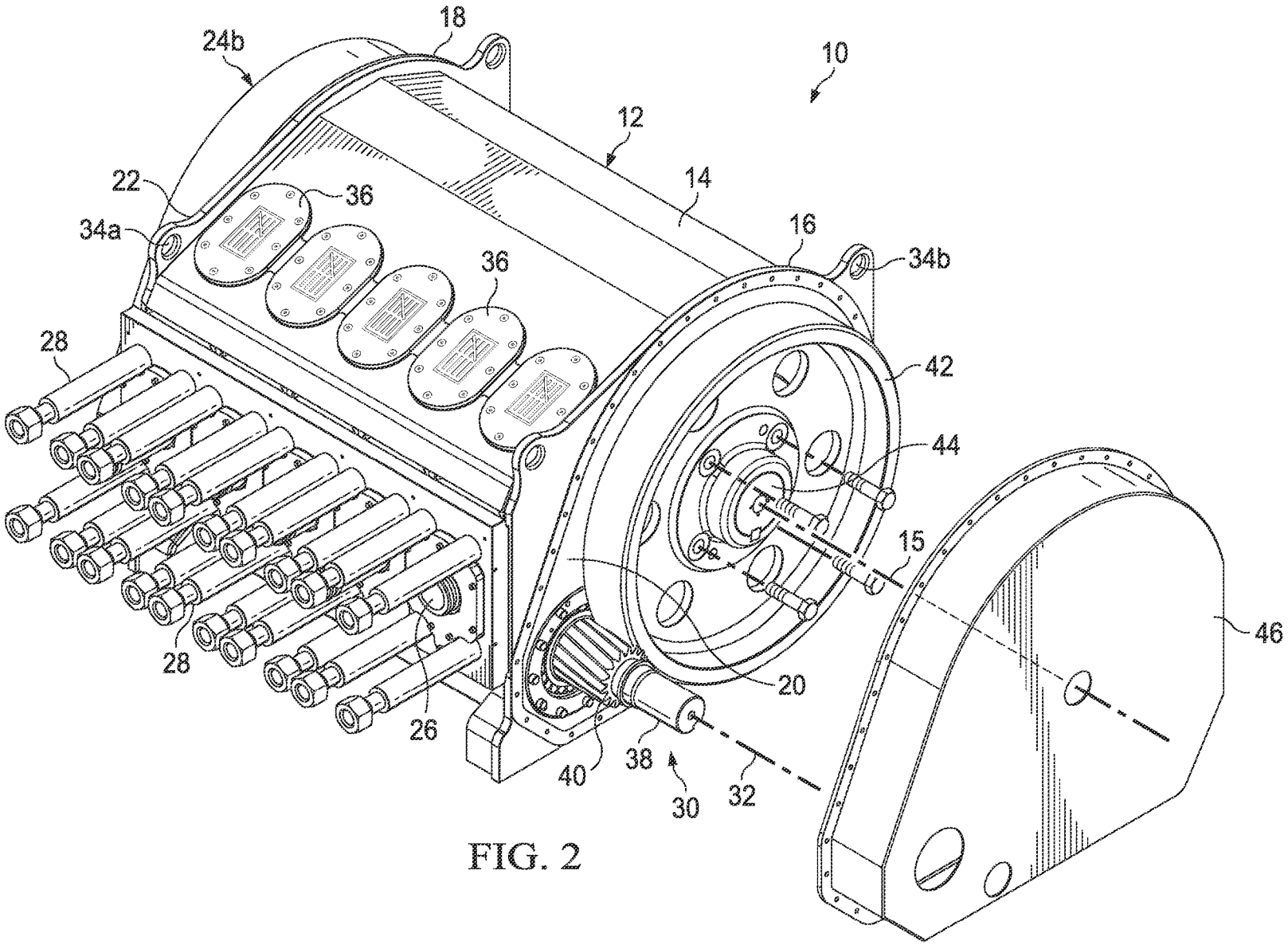
FIG. 2 is a partially exploded perspective view of the power end shown in FIG. 1.

Turning to FIG. 2, additional details of gearbox assembly 24 and pinion gear assembly 30 are illustrated by a partially exploded perspective view of power end 10. Pinion gear assembly 30 is shown as having a pinion shaft 38 extending along pinion axis 32. Disposed along at least a portion of pinion shaft 38 are one or more pinion gears 40. Pinion gear 40 meshes with a gearset 42 forming part of gearbox assembly 24. Gearset 42 engages the crankshaft 44 which is disposed along crankcase axis 15. In one or more embodiments, gearset 42 is a bull gear that is mounted on crankshaft 44. Gearbox assembly 24 further includes a gearbox housing 46 which attaches to crankcase housing 14 at first end 16.

Figure 3:
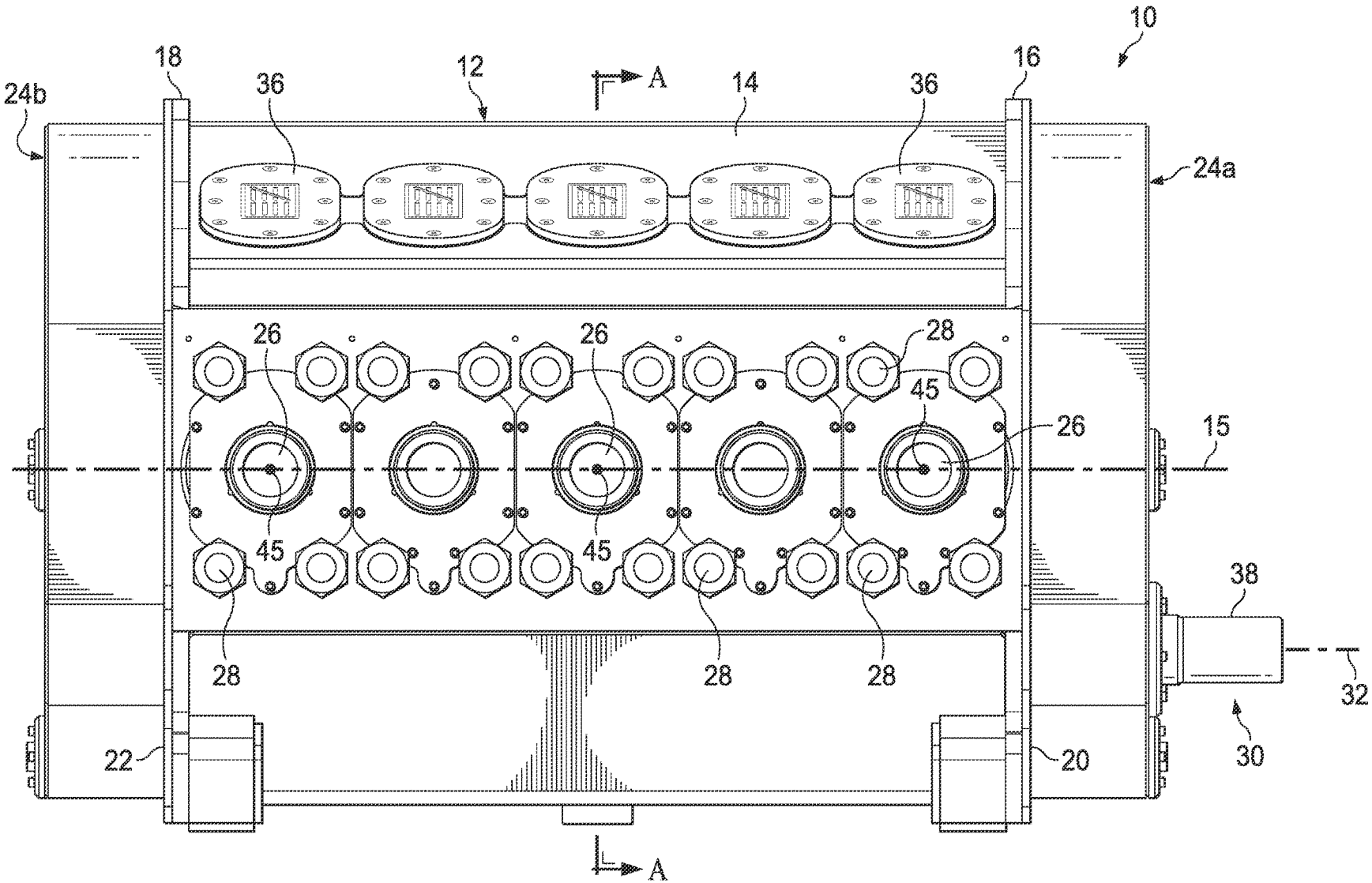
FIG. 3 is a front elevation view of the power end shown in FIG. 1.

FIG. 3 is a front elevation view of power end 10. The first end 16 and a second end 18 of crankcase hosing 14 are shown, and in particular the first side 20 enclosing the crankcase housing 14 at the first end 16 and the second side 22 enclosing the crankcase housing 14 at the second end 18. First gearbox assembly 24*a* is attached to the first end 16 of crankcase 12 and second gearbox assembly 24*b* is attached to the second end 18 of crankcase 12.

Crankcase housing 14 has crankcase axis 15 extending therethrough. As shown, each crosshead extension rod 26 is generally formed along a crosshead axis 45 which is generally perpendicular to crankcase axis 15. In one or more embodiments, crosshead axis 45 intersects crankcase axis 15. As shown, pinion axis 32 is generally parallel with, but spaced apart from crankcase axis 15. Each crosshead extension rod 26 is shown having four stay rods 28 adjacent thereto. The pinion shaft 38 of pinion gear assembly 30 is shown extending only from first end 16 of crankcase housing 14, and in particular, extending through gearbox assembly 24*a*. The interior of crankcase housing 14 can be accessed through removable access covers 36. Section line A-A is shown passing through crankcase housing 14.

Figure 4:
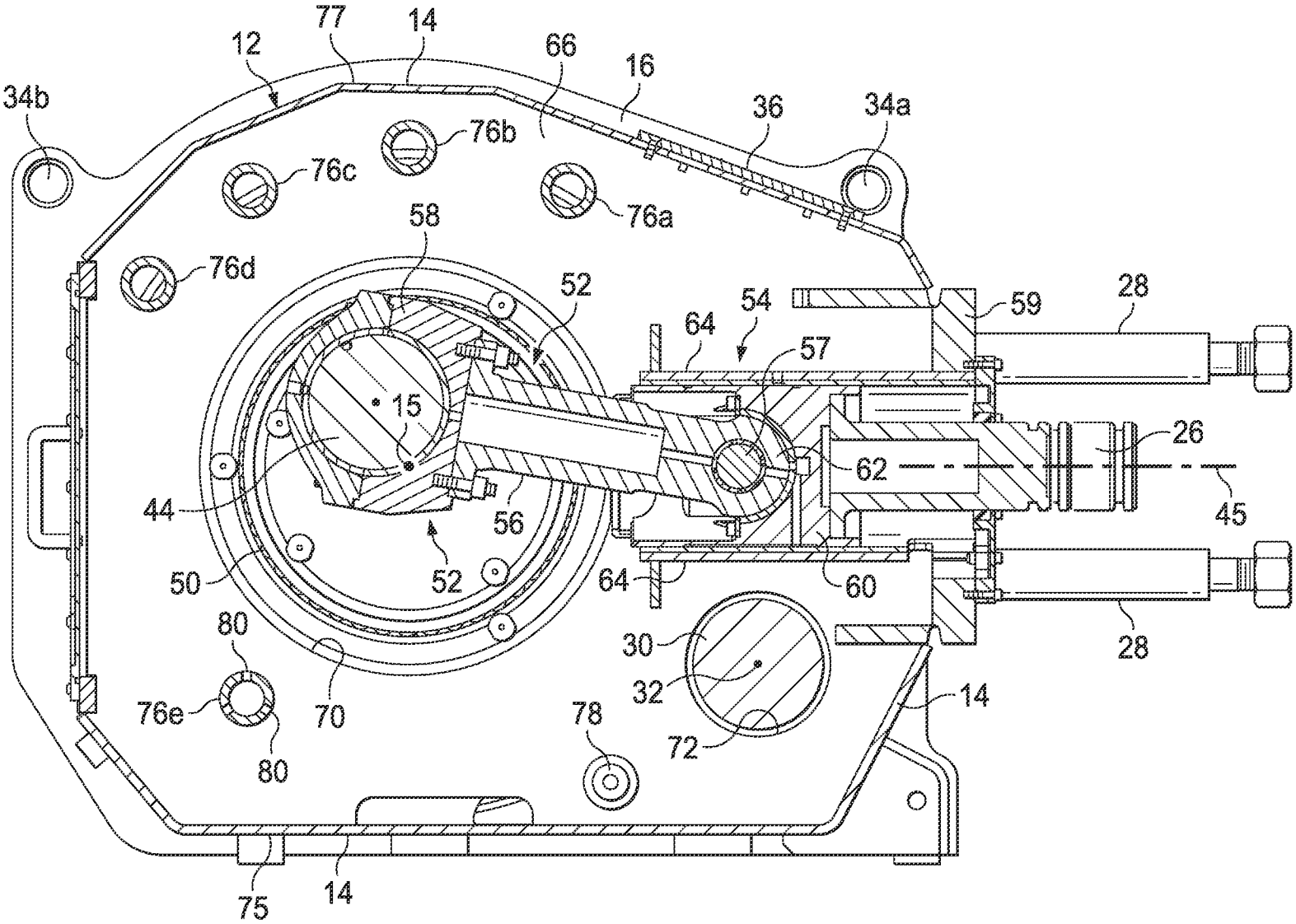
FIG. 4 is a cut-away side elevation view of the power end shown in FIG. 1.

FIG. 4 is a cut-away side view of crankcase 12 as seen along section line A-A of FIG. 3. Crankcase housing 14 is shown enclosing crankshaft 44, which extends along crankcase axis 15. Crankshaft 44 is supported by bearings 50. A piston rod assembly 52 is shown interconnecting crankshaft 44 with a crosshead assembly 54. Specifically, piston rod assembly 52 has a piston arm 56 which is pivotally coupled to crankshaft 44 at a first end 58 of piston arm 56, and is pivotally coupled to a crosshead 60 of crosshead assembly 54 at a second end 62 of piston arm 56 by a connecting pin 57. Crosshead 60 is restrained by crosshead guides 64 to move reciprocally along crosshead axis 45. Crosshead 60 is attached to crosshead extension rod 26. Crankcase housing 14 may further include a rod seal plate 59 supporting crosshead assembly 54, wherein one or more crosshead apertures 61 are formed in rod seal plate 59, each crosshead aperture 61 generally coaxial with crosshead axis 45.

A rib 66 is shown as extending within crankcase housing 14 so as to be generally perpendicular to crankcase axis 15 and generally parallel with crosshead axis 45. As will be discussed below, in one or more embodiments, crankcase housing 14 may include a plurality of spaced apart ribs 66 within crankcase housing 14 between the first and second ends 16, 18 of crankcase housing 14. Shown formed within rib 66 is a crankshaft aperture 70 generally coaxial with crankcase axis 15 and a pinion aperture 72 generally coaxial with pinion axis 32. Together, the crankshaft apertures 70 of the plurality of spaced apart ribs form a crankshaft bore through which crankshaft 44 extends. Likewise, together, the pinion apertures 72 of spaced apart ribs form a pinion bore through which crankshaft 44 extends.

At least one torsion tube 76 is shown extending through crankcase housing 14 so as to be generally parallel with crankcase axis 15, and thus generally perpendicular to rib 66. Torsion tube 76 is affixed to rib 66 thereby providing support to rib 66. In one or more embodiments, torsion tube 76 is affixed to each rib 66 that torsion tube 76 intersects. In one or more embodiments, plurality of torsion tubes 76 may extend within crankcase housing 14. In the illustrated embodiment, at least 4 torsion tubes 76*a*, 76*b*, 76*c* and 76*d* are illustrated. Torsion tubes 76 may be hollow or solid in cross-section. Torsion tubes 76 may be positioned to extend through those portions of crankcase housing 14 which experiences the greatest degree of flexing during operation and/or movement. Thus, in some embodiments, the plurality of torsion tubes 76 may be positioned in crankcase housing 14 so as to be spaced away from pinion gear assembly 30 and crosshead assembly 54. In one or more embodiments, crankcase housing has a base 75 and an upper surface 77 where access ports 36 and/or eyes 34 are generally positioned adjacent the upper surface 77. One or more of the ribs 66 extend from adjacent the base 75 to adjacent the upper surface 77. The plurality of torsion tubes 76 may generally be positioned within crankcase housing 14 adjacent the upper surface 77 to minimize flexing of this portion of crankcase 12.

In one or more embodiments, an oil distribution tube 78 may also extend within crankcase housing 14 between the first and second ends 16, 18. Oil distribution tube 78 is in fluid communication with oil port 37 of FIG. 1 to provide lubrication oil to the interior of crankcase housing 14.

In one or more embodiments, a torsion tube such as 76*e* may include apertures 80 and thus may be utilized as an oil distribution tube. Any oil distribution tube as described herein is in fluid communication with an oil source (not shown), such as an oil pump or an oil reservoir as is well known in the industry.

Finally, it will be appreciated by persons of skill in the art that while crankshaft 44 is coaxial with crankcase axis 15, the individual crank pins (not shown) of the driveshaft to which piston rod 56 is attached in an orbit about crankcase axis 15 as shown in FIG. 4.

Figure 5:
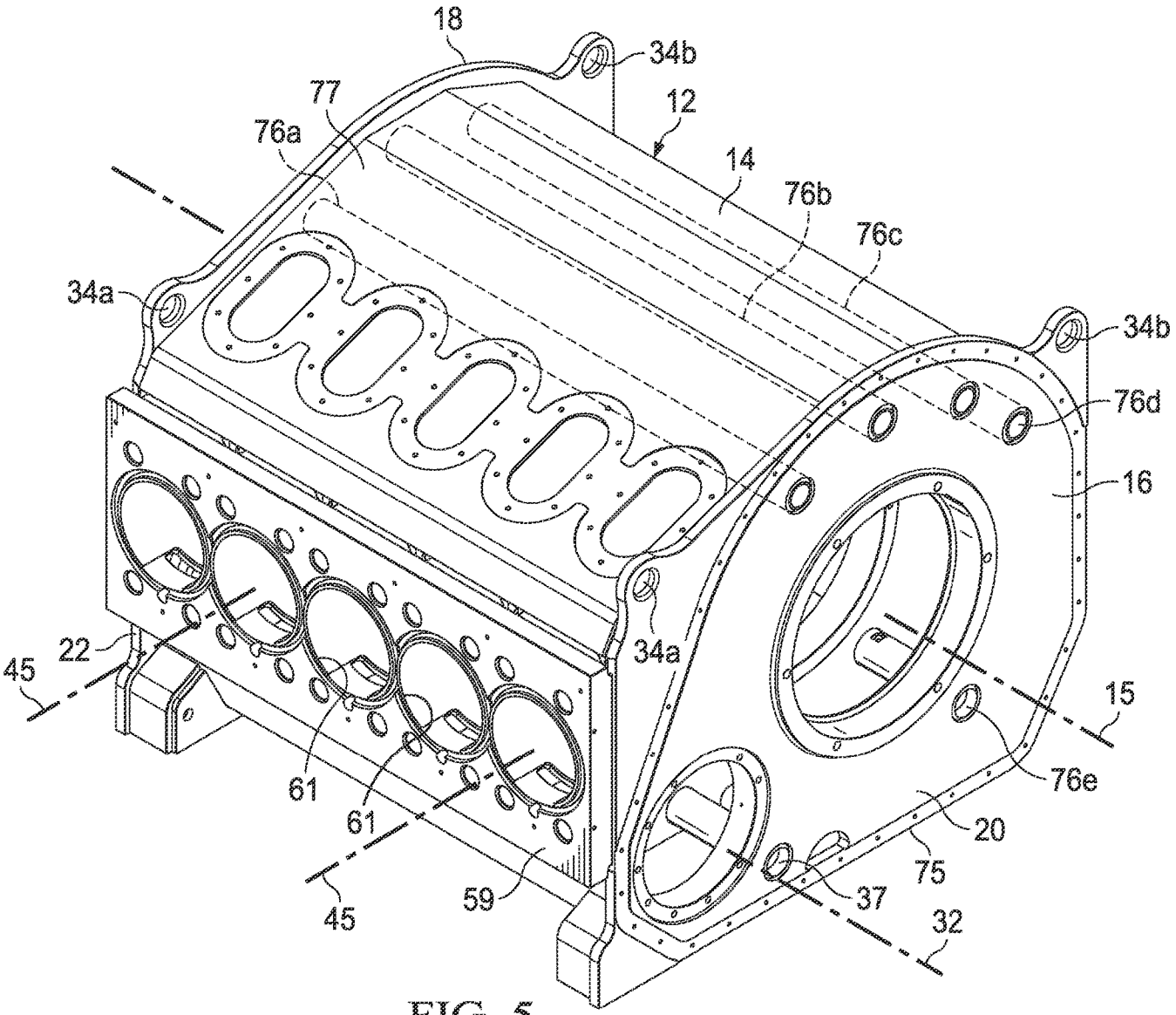
FIG. 5 is a perspective view of the crankshaft housing of a hydraulic fracturing pump system according to embodiments of the present disclosure.
Figure 6:
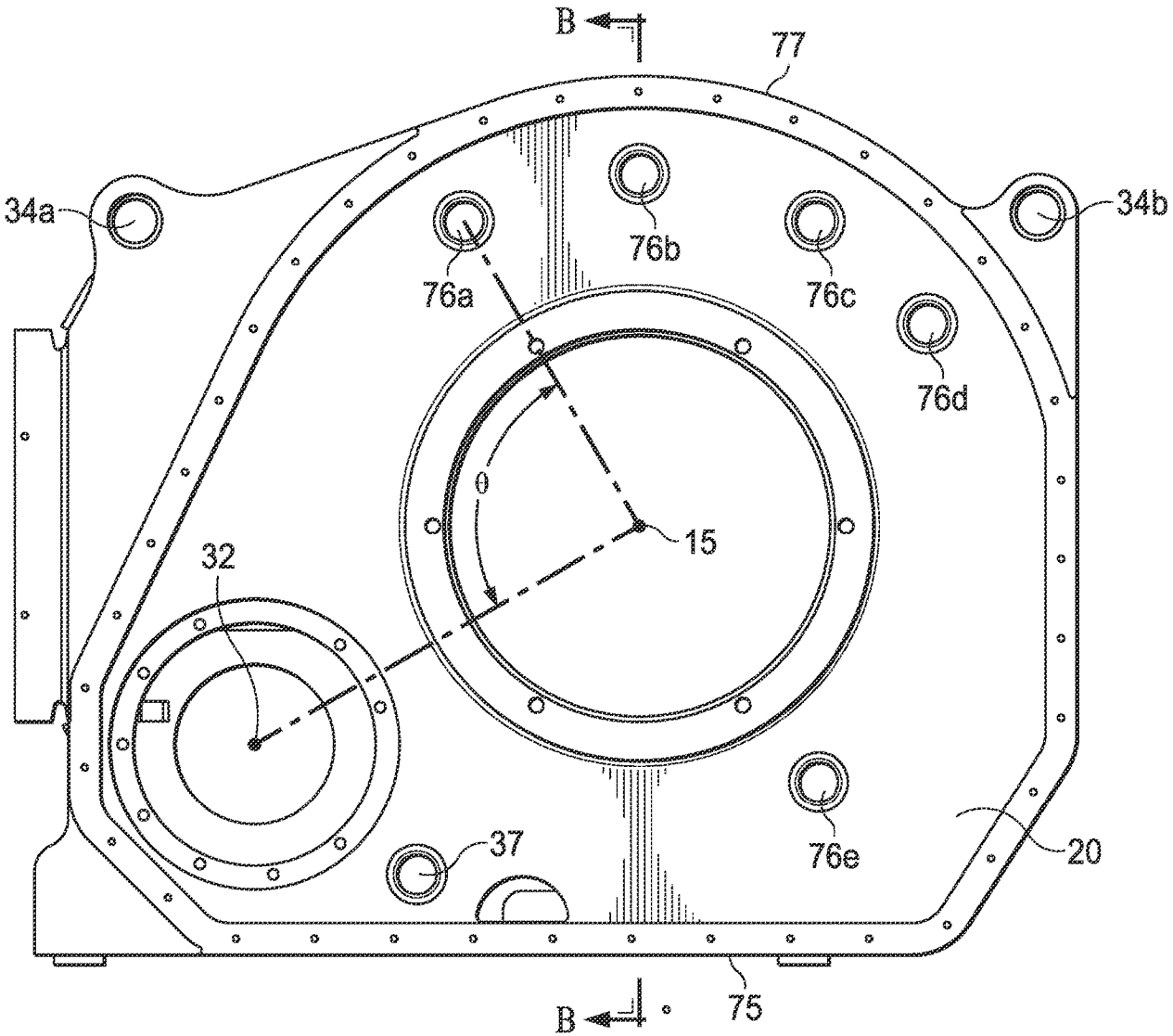
FIG. 6 is a side elevation view of the crankshaft housing shown in FIG. 5.

Turning to FIGS. 5 and 6, crankcase 12, and in particular, crankcase housing 14 is shown to better illustrate torsion tube(s) 76. As shown, a plurality of torsion tubes 76*a*, 76*b*, 76*c* and 76*d* extend from first side 20 at first end 16 of crankcase housing 14 to second side 22 at second end 18 of crankcase housing 14. Each torsion tube 76 is generally parallel with crankcase axis 15. Although the placement of torsion tube(s) 76 is not limited to a particular configuration, in one or more embodiments, torsion tube(s) 76 may be positioned to extend through those portions of crankcase housing 14 which experiences the greatest degree of flexing during operation and/or movement. This has been found to generally be in the upper portions of crankcase housing 14 since the lower portions of crankcase housing 14 are stiffened by the pinion gear assembly 30 and the crosshead assembly 54, in addition to the base 75 of the crankcase housing 14 generally being supported on the surface (not shown) on which the crankcase 12 is deployed. Thus, in some embodiments, the torsion tube(s) 76 may be positioned in crankcase housing 14 so as to be spaced away from the pinion axis 32, on the opposite side of crankcase axis 15 from pinion axis 32. In one or more embodiments, torsion tube(s) 76 may be spaced at least ninety degrees (90°) away from pinion axis 32 about crankcase axis 15 such that angle θ is at least ninety degrees (90°). In this regard, the torsion tube(s) 76 may be positioned adjacent upper surface 77 of crankcase housing 14. In one or more embodiments, torsion tube(s) 76 may be positioned adjacent upper surface 77 of crankcase housing 14 generally between the forward eye flanges 34*a* and the rear eye flanges 34*b*.

Figure 7:
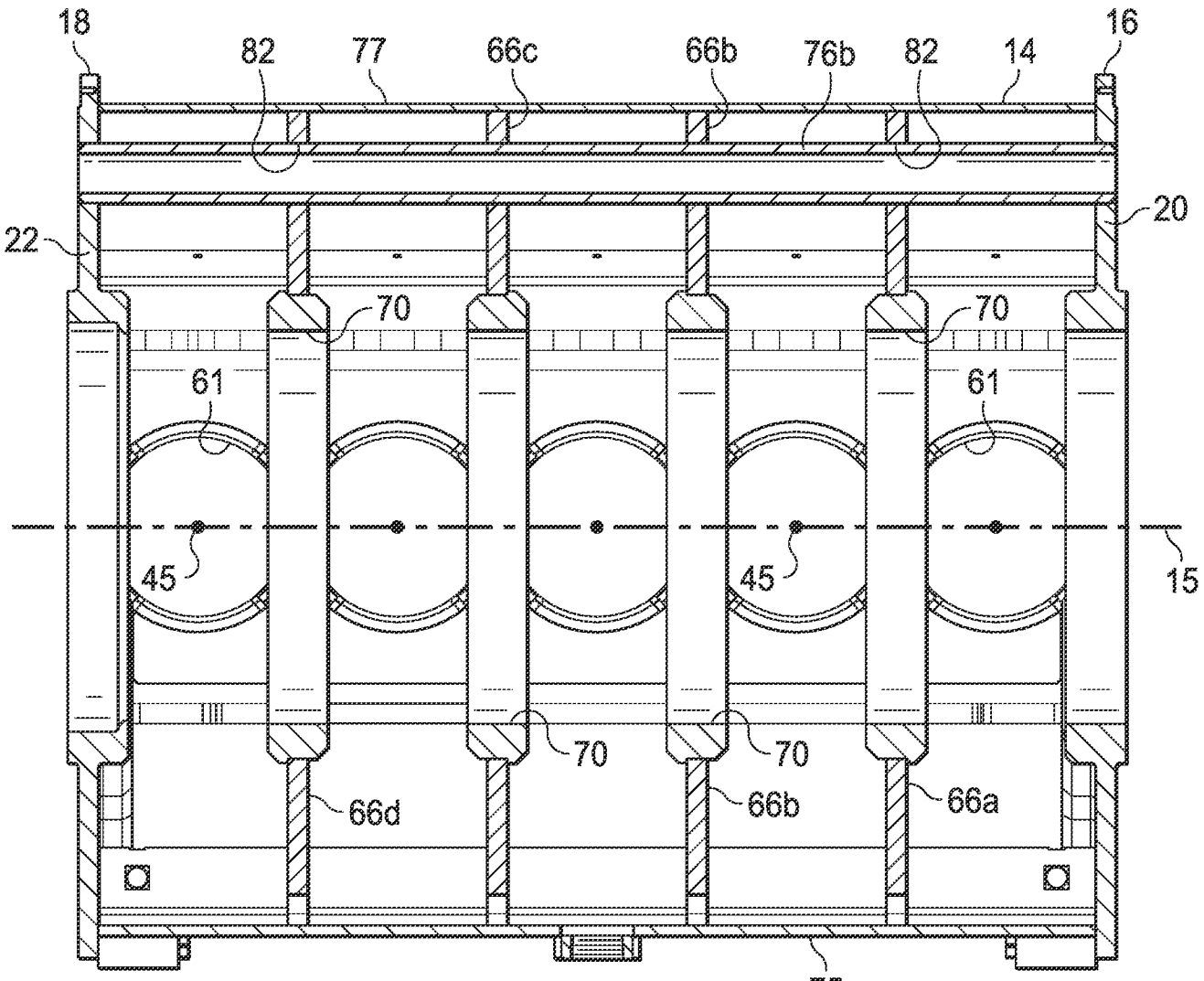
FIG. 7 a cut away rear elevation view of the crankshaft housing shown in FIG. 6.

Turning to FIG. 7, a cross-section of crankcase housing 14 is illustrated as taken along section line B-B of FIG. 6. Torsion tube 76*b* is shown extending into crankcase housing 14 from the first side 20 of first end 16 of crankcase housing 14. In one or more embodiments, torsion tube 76*b* extends from first side 20 to second side 22 at the second end 18 of crankcase housing 14. Torsion tube 76*b* intersects at least one rib 66 formed within crankcase housing 14, which rib 66 is generally perpendicular to torsion tube 76*b*. More specifically, rib 66 has an aperture 82 formed therein and through which torsion tube 76*b* passes. Torsion tube 76*b* may be affixed or attached to rib 66. In one or more embodiments, torsion tube 76*b* is welded to rib 66 at aperture 82 to rigidly affix the torsion tube 76*b* to the rib. In other embodiments, torsion tube 76*b* may be clamped, coupled, attached or otherwise secured to rib 66 in any manner well known in the industry. In the illustrated embodiment, torsion tube 76*b* passes through a plurality of ribs 66*a*, 66*b*, 66*c*, 66*d*, each of which has an aperture 82, and is affixed to each rib 66. Although torsion tube 76*b* extends from first end 16 to second end 18 of crankcase housing 14, in other embodiments, torsion tube 76*b* may simply extend between two or more ribs 66. Thus, in one or more embodiments, torsion tube 76*b* is extends between at least a first rib 66*a* and a second rib 66*b* and is affixed to each of the first and second ribs 66*a*, 66*b*. In any event, as illustrated, torsion tube 76*b* is generally parallel with crankcase axis 15 and perpendicular to ribs 66 and crosshead axis 45. In addition to aperture(s) 82, each rib has a large aperture 70 formed therein which aperture(s) 70 is generally coaxial with crankcase axis 15. Together apertures 70 form a bore through which crankshaft 44 (not shown) extends.

In any event, torsion tube 76*b* is illustrated as generally being positioned between crankcase axis 15 and upper surface 77 of crankcase housing 14. While other torsion tubes 76 may extend within crankcase housing 14 at any location, including adjacent base 75 of crankcase housing 14, in one or more embodiments, the plurality of torsion tubes 76 are positioned between crankcase axis 15 and upper surface 77. In this regard, torsion tubes 76 may be positioned adjacent upper surface 77. Although torsion tube 76*b* is illustrated as hollow, in other embodiments, torsion tube 76*b* may be solid. Moreover, while torsion tube(s) 76 are generally depicted as circular in cross-section, torsion tube(s) 76 may have any shape, including without limitation square or rectangular. Thus, in some embodiments, torsion tube 76 may be a solid rectangular bar. In any event, it will be understood that in such case, aperture 82 formed in rib 66 may be shaped to correspond with the shape of torsion tube 76 passing therethrough.

As described herein, power end 10 of a hydraulic fracturing pump may be coupled with any hydraulic fracturing pump wet end and will provide greater overall integrity to the hydraulic fracturing pump during operation.

Thus, a hydraulic fracturing pump has been described. The hydraulic fracturing pump may generally include a crankcase housing having a first side at a first end of the crankcase housing and a second side at a second end of the crankcase housing, an upper surface extending between the first and second sides and a base and, the crankcase housing formed along a crankcase axis extending between the two ends, the crankcase housing further having a plurality of crosshead apertures formed in the crankcase housing, each crosshead aperture formed about a crosshead axis that is generally perpendicular to the crankcase axis; a plurality of ribs within the crankcase housing between the two ends, each rib generally perpendicular to the crankcase axis and each rib having at least a first torsion tube aperture and a second torsion tube aperture formed therein and further having a crankshaft aperture formed therein, each crankshaft aperture generally coaxially with the crankcase axis; at least two torsion tubes positioned between the two ends of the crankcase housing and between the crankcase axis and the upper surface, each torsion tube intersecting a plurality of ribs, passing through a torsion tube aperture of each rib, wherein each torsion tube is rigidly affixed to each of the plurality of ribs. In other embodiments, the hydraulic fracturing pump may include a crankcase housing having a first side at a first end of the crankcase housing and a second side at a second end of the crankcase housing, an upper surface extending between the first and second sides and a base and, the crankcase housing formed along a crankcase axis extending between the two ends, the crankcase housing further having a plurality of crosshead apertures formed in the crankcase housing, each crosshead aperture formed about a crosshead axis that is generally perpendicular to the crankcase axis; a plurality of ribs within the crankcase housing between the two ends, each rib generally perpendicular to the crankcase axis and parallel with the crosshead axis, each rib having at least a first torsion tube aperture formed therein and each rib further having a crankshaft aperture formed therein, each crankshaft aperture generally coaxially with the crankcase axis; one or more torsion tubes positioned between the two ends of the crankcase housing and between the crankcase axis and the upper surface of the crankcase housing, each torsion tube intersecting a plurality of ribs, passing through a torsion tube aperture of each rib, wherein each torsion tube is affixed to each of the plurality of ribs. In yet other embodiments, the hydraulic fracturing pump may include a crankcase housing having a first side at a first end of the crankcase housing and a second side at a second end of the crankcase housing, an upper surface extending between the first and second sides and a base and, the crankcase housing formed along a crankcase axis extending between the two ends, the crankcase housing further having a plurality of crosshead apertures formed in the crankcase housing, each crosshead aperture formed about a crosshead axis that is generally perpendicular to the crankcase axis; a plurality of ribs within the crankcase housing between the two ends, each rib generally perpendicular to the crankcase axis and each rib having at least a first torsion tube aperture and a second torsion tube aperture formed therein and further having a crankshaft aperture formed therein, each crankshaft aperture generally coaxially with the crankcase axis; a crankshaft extending along the crankcase axis; a piston arm pivotally coupled to the crankshaft at a first end of piston arm, the piston arm pivotally coupled to a crosshead at a second end of the piston arm, the crosshead reciprocal along the crosshead axis; and at least two torsion tubes positioned between the two ends of the crankcase housing and between the crankcase axis and the upper surface, each torsion tube intersecting a plurality of ribs, passing through a torsion tube aperture of each rib, wherein each torsion tube is rigidly affixed to each of the plurality of ribs. Still yet other embodiments of a power end of a hydraulic fracturing pump may include a crankcase housing having a first side at a first end of the crankcase housing and a second side at a second end of the crankcase housing, an upper surface extending between the first and second sides and a base and, the crankcase housing formed along a crankcase axis extending between the two ends, the crankcase housing further having a plurality of crosshead apertures formed in the crankcase housing, each crosshead aperture formed about a crosshead axis that is generally perpendicular to the crankcase axis; a plurality of ribs within the crankcase housing between the two ends, each rib generally perpendicular to the crankcase axis and each rib having at least a first torsion tube aperture and a second torsion tube aperture formed therein and further having a crankshaft aperture formed therein, each crankshaft aperture generally coaxially with the crankcase axis, each rib having a pinion aperture formed therein about a pinion axis that is generally parallel with the crankshaft axis, a crankshaft extending along the crankcase axis; a piston arm pivotally coupled to the crankshaft at a first end of piston arm, the piston arm pivotally coupled to a crosshead at a second end of the piston arm, the crosshead reciprocal along the crosshead axis; a pinion assembly extending along the pinion axis, the pinion assembly having a pinion gear meshed with a gearset that engages the crankshaft; and at least two torsion tubes positioned between the two ends of the crankcase housing and between the crankcase axis and the upper surface, each torsion tube intersecting a plurality of ribs, passing through a torsion tube aperture of each rib, wherein each torsion tube is rigidly affixed to each of the plurality of ribs, wherein the pinion assembly is positioned below the crosshead axis and the at least two torsion tubes are positioned above the crosshead axis.

For any of the foregoing embodiments, the hydraulic fracturing pump may include any one of the following elements, alone or in combination with each other:

- A plurality of torsion tubes positioned between the two ends of the crankcase housing, each torsion tube extending from the first side to the second side.
- The torsion tubes extend from the first side to the second side of the crankcase housing.
- The torsion tubes are hollow.
- The torsion tubes are solid.
- The torsion tubes have a circular cross-section.
- A crankshaft aperture formed in the first side of the crankshaft housing.
- Each rib having a pinion aperture formed therein about a pinion axis that is generally parallel with the crankshaft axis.
- A pinion aperture formed in the first side of the crankshaft housing about a pinion axis that is generally parallel with the crankshaft axis.
- A pinion aperture formed in the first side and the second side of the crankshaft housing, the pinion apertures formed about a pinion axis that is generally parallel with the crankshaft axis.
- The plurality of torsion tubes spaced apart at least ninety degrees from the pinion axis about the crankshaft axis.
- The torsion tubes have a rectangular cross-section.
- At least one torsion tube has an aperture formed therein.
- At least one torsion tube has a plurality of apertures formed therein along at least a portion of the length of the torsion tube.
- A crankshaft extending along the crankcase axis; a piston arm pivotally coupled to the crankshaft at a first end of piston arm, the piston arm pivotally coupled to a crosshead at a second end of the piston arm, the crosshead reciprocal along the crosshead axis.
- A pinion assembly extending along the pinion axis, the pinion assembly having a pinion gear meshed with a gearset that engages the crankshaft.
- The pinion assembly is positioned below the crosshead axis and the plurality of torsion tubes are positioned above the crosshead axis.
- The gearset is a bull gear mounted on the crankshaft.
- A plurality of piston arms spaced apart from one another along the crankshaft and a corresponding plurality of crossheads, each piston arm pivotally coupled to the crankshaft at a first end of piston arm, and each piston arm pivotally coupled to a crosshead at a second end of the piston arm, each crosshead reciprocal along a crosshead axis.
- A crosshead extension rod fastened to each crosshead and extending through a crosshead aperture.
- The crosshead apertures are formed in rod seal plate adjacent the crosshead.
- At least one torsion tube is an oil distribution tube having a plurality of apertures formed therein along at least a portion of the length of the torsion tube and in fluid communication with an oil source.
- An oil distribution tube is positioned adjacent the base of the crankcase housing.
- An oil disturbing tube is positioned adjacent the pinion assembly.
- A wet end of a hydraulic fracturing pump coupled to the power end of the hydraulic fracturing pump.
- Each torsion tube is affixed to a plurality of ribs.
- Each torsion tube is welded to a plurality of ribs.
- Each torsion tube is attached to a plurality of ribs.
- Crosshead axis perpendicularly intersects crankcase axis.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed;

rather, the intention is to cover all modifications, equivalents, and alternatives falling within the spirit and scope of the disclosure as defined by the appended claims.

What is claimed:

1. A hydraulic fracturing pump comprising:

a crankcase housing forming an enclosure for receiving oil, the crankcase housing having a first enclosing side at a first end of the crankcase housing and a second enclosing side at a second end of the crankcase housing, an upper surface extending between the first and second enclosing sides and a base thereby defining a crankcase interior, the crankcase housing formed along a crankcase axis extending between the two ends, the crankcase housing further having a plurality of crosshead apertures formed in the crankcase housing, each crosshead aperture formed about a crosshead axis that is generally perpendicular to the crankcase axis;

a gearbox assembly mounted directly on at least one of the first enclosing side and the second enclosing side;

a plurality of ribs enclosed within the crankcase housing between the two ends and spaced apart from the first enclosing side and the second enclosing side of the crankcase housing, each rib generally perpendicular to the crankcase axis and each rib having at least a first torsion tube aperture and a second torsion tube aperture formed therein and further having a crankshaft aperture formed therein, each crankshaft aperture generally coaxially with the crankcase axis;

a crankshaft extending along the crankcase axis and passing through the crankshaft aperture formed in each of the plurality of ribs; and at least two hollow torsion tubes, each hollow torsion tube having a first end and a second end with the first end of each hollow torsion tube affixed to the crankcase housing first enclosing side and the second end of each hollow torsion tube affixed to the crankcase housing second enclosing side, the hollow torsion tubes positioned within the crankcase interior of the crankcase housing and between the crankcase axis and the upper surface, each hollow torsion tube intersecting a plurality of ribs, passing through a torsion tube aperture of each rib and affixed to at least a portion of the ribs through which the hollow torsion tube passes.

2. The hydraulic fracturing pump of claim 1, wherein the hollow torsion tubes are positioned adjacent the crankshaft.

3. The hydraulic fracturing pump of claim 2, wherein at least a portion of the hollow torsion tubes are positioned within the crankcase housing between the crankshaft and the upper surface.

4. The hydraulic fracturing pump of claim 1, wherein each hollow torsion tube is attached to the plurality of ribs.

5. The hydraulic fracturing pump of claim 4, wherein each hollow torsion tube is welded to a plurality of ribs.

6. The hydraulic fracturing pump of claim 1, further comprising an additional torsion tube within the crankcase interior and extending between the first end and the second end adjacent the base, the additional torsion tube being an oil distribution tube having a plurality of apertures formed therein along at least a portion of the length of the additional torsion tube and in fluid communication with an oil source.

7. The hydraulic fracturing pump of claim 1, further comprising a plurality of piston arms spaced apart from one another along the crankshaft; and a corresponding plurality of crossheads; wherein each piston arm pivotally coupled to the crankshaft at a first end of piston arm, and each piston arm pivotally coupled to a crosshead at a second end of the piston arm, each crosshead reciprocal along a crosshead axis.

8. The hydraulic fracturing pump of claim 1, wherein the first enclosing side and the second enclosing side are each generally perpendicular to the crankcase axis and each enclosing side has at least a first torsion tube aperture and a second torsion tube aperture formed in each enclosing side, wherein one of the at least two hollow torsion tubes extends from each aperture.

9. The hydraulic fracturing pump of claim 8, wherein each of the first end and second end of each of the at least two hollow torsion tubes is welded to an enclosing side of the crankcase housing.

10. The hydraulic fracturing pump of claim 1, wherein the one or more hollow torsion tubes comprises a plurality of hollow torsion tubes positioned within the crankcase interior, each of the plurality of hollow torsion tubes extending from the first enclosing side to the second enclosing side, the hydraulic fracturing pump further comprising a plurality of apertures formed in each enclosing side of the crankcase and corresponding to the plurality of hollow torsion tubes, wherein each of the plurality of hollow torsion tubes extends from a separate one of the plurality of apertures in the first enclosing side to a separate one of the plurality of apertures in the second enclosing side.

11. A hydraulic fracturing pump, the hydraulic fracturing pump comprising:

a crankcase housing forming an enclosure for receiving oil, the crankcase housing having a first enclosing side at a first end of the crankcase housing and a second enclosing side at a second end of the crankcase housing, an upper surface extending between the first and second sides and a base thereby defining a crankcase interior, the crankcase housing formed along a crankcase axis extending between the two ends, the crankcase housing further having a plurality of crosshead apertures formed in the crankcase housing, each crosshead aperture formed about a crosshead axis that is generally perpendicular to the crankcase axis;

a gearbox assembly mounted directly on at least one of the first enclosing side and the second enclosing side;

a plurality of ribs enclosed within the crankcase housing between the two ends and spaced apart from the first enclosing side and the second enclosing side of the crankcase housing, each rib generally perpendicular to the crankcase axis and parallel with the crosshead axis, each rib having at least a first torsion tube aperture formed therein and each rib further having a crankshaft aperture formed therein, each crankshaft aperture generally coaxially with the crankcase axis;

one or more hollow torsion tubes, each hollow torsion tube having a first end and a second end with the first end of each hollow torsion tube affixed to the crankcase housing first enclosing side and the second end of each hollow torsion tube affixed to the crankcase housing second enclosing side, the hollow torsion tubes positioned within the crankcase interior and between the two ends of the crankcase housing and between the crankcase axis and the upper surface of the crankcase housing, each hollow torsion tube intersecting a plurality of ribs, passing through a torsion tube aperture of each rib, wherein each hollow torsion tube is affixed to each of the plurality of ribs; and an additional torsion tube having a first end and a second end with the first end of the additional torsion tube affixed to the first enclosing side of the crankcase housing and the second end of the additional torsion tube affixed to the second enclosing side of the crankcase housing, the additional torsion tube positioned within the crankcase interior defined between the two ends of the crankcase housing, wherein the additional torsion tube is an oil distribution tube having a plurality of apertures formed therein along at least a portion of the length of the additional torsion tube and in fluid communication with an oil source.

12. The hydraulic fracturing pump of claim 11, wherein the one or more hollow torsion tubes comprise a plurality of hollow torsion tubes positioned within the crankcase interior between the two ends of the crankcase housing, each of the plurality of hollow torsion tubes extending from the first enclosing side to the second enclosing side.

13. The hydraulic fracturing pump of claim 12, wherein each of the plurality of hollow torsion tubes has a circular cross-section.

14. The hydraulic fracturing pump of claim 11, further comprising a crankshaft extending within the crankcase interior defined between the two ends of the crankcase housing along the crankcase axis; a plurality of piston arms spaced apart from one another along the crankshaft; and a corresponding plurality of crossheads; a crosshead extension rod fastened to each crosshead and extending through a crosshead aperture; wherein each piston arm pivotally coupled to the crankshaft at a first end of piston arm, and each piston arm pivotally coupled to a crosshead at a second end of the piston arm, each crosshead reciprocal along a crosshead axis.

15. The hydraulic fracturing pump of claim 14, wherein the crosshead apertures are formed in a rod seal plate adjacent the crosshead.

16. The hydraulic fracturing pump of claim 11, wherein the first end of each of the one or more hollow torsion tubes is welded to the first enclosing side of the crankcase housing and the second end of each of the one or more hollow torsion tubes is welded to the second enclosing side of the crankcase housing.

17. A hydraulic fracturing pump comprising:

a crankcase housing forming an enclosure for receiving oil, the crankcase housing having a first enclosing side at a first end of the crankcase housing and a second enclosing side at a second end of the crankcase housing, an upper surface extending between the first and second enclosing sides and a base, wherein the first enclosing side and the second enclosing side are each generally perpendicular to the crankcase axis and each enclosing side has at least a first torsion tube aperture and a second torsion tube aperture formed therein, the crankcase housing formed along a crankcase axis extending between the two ends, the crankcase housing further having a crosshead aperture formed in the crankcase housing, the crosshead aperture formed about a crosshead axis that is generally perpendicular to the crankcase axis;

a gearbox assembly mounted directly on at least one of the first enclosing side and the second enclosing side;

a plurality of ribs enclosed within the crankcase housing between the two ends, each rib generally perpendicular to the crankcase axis and each rib having at least a first torsion tube aperture and a second torsion tube aperture formed therein and further having a crankshaft aperture formed therein, each crankshaft aperture generally coaxially with the crankcase axis;

a crankshaft extending along the crankcase axis;

a piston arm pivotally coupled to the crankshaft at a first end of piston arm, the piston arm pivotally coupled to a crosshead at a second end of the piston arm, the crosshead reciprocal along the crosshead axis;

at least two hollow torsion tubes, each torsion tube having a first end and a second end with the first end affixed to and extending from an aperture in the crankcase housing first enclosing side and the second end affixed to and extending from an aperture in the crankcase housing second enclosing side, the hollow torsion tubes positioned between the two ends of the crankcase housing and between the crankcase axis and the upper surface, each torsion tube intersecting a plurality of ribs, passing through a torsion tube aperture of each rib, wherein each torsion tube is attached to each of the plurality of ribs; and an additional hollow torsion tube having a first end and a second end with the first end affixed to and extending from an aperture in the first enclosing side and second end affixed to and extending from an aperture in the second enclosing side, the additional torsion tube positioned within the crankcase interior between the first enclosing side and the second enclosing side of the crankcase housing and substantially parallel with the crankcase axis, wherein the additional torsion tube is an oil distribution tube having a plurality of apertures formed therein along at least a portion of the length of the additional torsion tube and in fluid communication with an oil source.

18. The hydraulic fracturing pump of claim 17, wherein the at least two hollow torsion tubes comprise a plurality of hollow torsion tubes positioned within the crankcase interior between the two ends of the crankcase housing, each of the plurality of hollow torsion tubes extending from the first enclosing side to the second enclosing side of the crankcase housing and passing through a plurality of ribs and each of the plurality of hollow torsion tubes welded to the plurality of ribs through which the torsion tube passes.

19. The hydraulic fracturing pump of claim 17, wherein the crosshead aperture is formed in a rod seal plate adjacent the crosshead.

* * * * *